US010404014B2

(12) United States Patent
Huang et al.

(10) Patent No.: US 10,404,014 B2
(45) Date of Patent: Sep. 3, 2019

(54) STACKING ELECTRICAL CONNECTOR WITH REDUCED CROSSTALK

(71) Applicant: FCI USA LLC, Etters, PA (US)

(72) Inventors: Yifan Huang, New Cumberland, PA (US); Madhumitha Rengarajan, Mechanicsburg, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 15/898,098

(22) Filed: Feb. 15, 2018

(65) Prior Publication Data

US 2018/0241156 A1 Aug. 23, 2018

Related U.S. Application Data

(60) Provisional application No. 62/460,644, filed on Feb. 17, 2017.

(51) Int. Cl.
*H01R 12/00* (2006.01)
*H01R 13/6471* (2011.01)
(Continued)

(52) U.S. Cl.
CPC ..... *H01R 13/6471* (2013.01); *H01R 12/716* (2013.01); *H01R 13/41* (2013.01); *H01R 13/6477* (2013.01)

(58) Field of Classification Search
CPC ..... H01R 13/6471; H01R 13/6477; H01R 12/716; H01R 13/41
(Continued)

(56) References Cited

U.S. PATENT DOCUMENTS 3,259,869 A 7/1966 Batcheller
3,411,127 A 11/1968 Adams
(Continued)

FOREIGN PATENT DOCUMENTS

CN 101006614 A 7/2007
CN 203277706 U 11/2013
(Continued)

OTHER PUBLICATIONS

U.S. Appl. No. 13/836,610, filed Mar. 15, 2013, Buck et al.
(Continued)

*Primary Examiner* — Abdullah A Riyami
*Assistant Examiner* — Nelson R. Burgos-Guntin
(74) *Attorney, Agent, or Firm* — Wolf, Greenfield & Sacks, P.C.

(57) ABSTRACT

An electrical connector having one or more openings formed in the connector's housing between adjacent rows of conductors. The openings may be positioned between rows of contact portions, and reduces crosstalk between conductors in adjacent rows. The opening(s) may extend through the entire length of the connector's housing. The opening(s) may have any suitable shape. In some embodiments, the openings may comprise a slot, bifurcated by crossbeams. The crossbeams may have ends positioned between signal conductors in the same row of the same type, either signal or ground. Alternatively or additionally, the crossbeams may be angled with respect to the rows of contacts such that the ends are positioned proximate conductors of a first type in one row and proximate conductors of a second type in another row.

25 Claims, 9 Drawing Sheets

(51) Int. Cl.
*H01R 12/71* (2011.01)
*H01R 13/41* (2006.01)
*H01R 13/6477* (2011.01)

(58) Field of Classification Search
USPC ..... 439/72, 676
See application file for complete search history.

(56) References Cited

U.S. PATENT DOCUMENTS 3,865,462 A 2/1975 Cobaugh et al.
4,241,970 A 12/1980 Rider, Jr. et al.
4,740,180 A 4/1988 Harwath et al.
5,267,881 A 12/1993 Matuzaki
5,290,181 A 3/1994 Bixler et al.
5,558,542 A 9/1996 O'Sullivan et al.
5,692,928 A 12/1997 Nelson et al.
5,795,191 A 8/1998 Preputnick et al.
5,957,734 A 9/1999 Gladd et al.
5,980,337 A 11/1999 Little
6,024,584 A 2/2000 Lemke et al.
6,042,389 A 3/2000 Lemke et al.
6,079,991 A 6/2000 Lemke et al.
6,093,035 A 7/2000 Lemke et al.
6,139,336 A 10/2000 Olson
6,146,202 A 11/2000 Ramey et al.
6,164,983 A 12/2000 Lemke et al.
6,183,268 B1 2/2001 Consoli et al.
6,193,537 B1 2/2001 Harper, Jr. et al.
6,247,635 B1 6/2001 Olson
6,325,644 B1 12/2001 Lemke et al.
6,358,068 B1 3/2002 Houtz
6,371,784 B1 4/2002 Scholz et al.
6,425,785 B1 7/2002 Azuma
6,454,157 B2 9/2002 Olson
6,488,550 B1 12/2002 Kikuchi et al.
6,565,368 B1 5/2003 Liao et al.
6,623,284 B1 9/2003 Korsunsky
6,699,048 B2 3/2004 Johnson et al.
6,848,944 B2 2/2005 Evans
6,860,741 B2 3/2005 Ashmann et al.
6,869,292 B2 3/2005 Johnescu et al.
6,872,085 B1 3/2005 Cohen et al.
6,899,547 B1 * 5/2005 Chang ..... H01R 13/6586 439/65
6,939,173 B1 9/2005 Elco et al.
7,059,873 B2 6/2006 Johnescu et al.
7,097,465 B1 8/2006 Korsunsky et al.
7,214,104 B2 5/2007 Minich et al.
7,322,855 B2 1/2008 Mongold et al.
7,341,482 B2 3/2008 Ngo
7,371,094 B1 5/2008 Tokuhashi et al.
7,431,616 B2 10/2008 Minich
D585,031 S 1/2009 Hung
7,503,773 B2 * 3/2009 Tokunaga ..... H01R 12/58 439/74
7,585,185 B2 * 9/2009 Obikane ..... H01R 12/52 439/607.01
7,597,581 B2 10/2009 Trout et al.
7,632,107 B2 * 12/2009 Mizumura ..... H01R 23/68 439/108
7,766,670 B1 8/2010 Ju
7,985,079 B1 * 7/2011 Wilson ..... H01R 12/52 439/74
8,257,095 B2 * 9/2012 Akai ..... H01R 12/716 439/248
9,257,778 B2 2/2016 Buck et al.
9,520,661 B1 12/2016 Horning et al.
9,543,703 B2 1/2017 Horchler et al.
9,735,484 B2 8/2017 Brubaker et al.
9,735,848 B2 8/2017 Saiwai et al.
9,831,605 B2 11/2017 Buck et al.
9,871,323 B2 1/2018 Horchler et al.
2002/0061687 A1 5/2002 Cachina et al.
2002/0098738 A1 7/2002 Astbury, Jr. et al.
2004/0175995 A1 9/2004 Tsai
2005/0020103 A1 1/2005 Spink, Jr.
2005/0142908 A1 6/2005 Harper, Jr.
2007/0021002 A1 1/2007 Laurx et al.
2007/0155241 A1 7/2007 Lappohn
2007/0175572 A1 8/2007 Rubin et al.
2007/0224845 A1 9/2007 Becker et al.
2008/0176418 A1 7/2008 Hougham et al.
2008/0207023 A1 8/2008 Tuin et al.
2008/0311768 A1 12/2008 Hougham et al.
2009/0023311 A1 1/2009 Goodman
2009/0264023 A1 10/2009 Yi et al.
2010/0015861 A1 1/2010 Zhang et al.
2010/0055988 A1 3/2010 Shuey et al.
2010/0093232 A1 4/2010 Trout et al.
2010/0240233 A1 9/2010 Johnescu et al.
2010/0291803 A1 11/2010 Kirk
2011/0097934 A1 4/2011 Minich
2011/0117781 A1 5/2011 Stoner
2012/0077380 A1 3/2012 Minich et al.
2012/0088378 A1 4/2012 Rathburn
2012/0202363 A1 * 8/2012 McNamara ..... H01R 13/6461 439/74
2013/0273781 A1 10/2013 Buck et al.
2014/0017957 A1 1/2014 Horchler et al.
2014/0148022 A1 5/2014 Mongold et al.
2014/0273553 A1 9/2014 Heppner et al.
2016/0134057 A1 5/2016 Buck et al.
2017/0125946 A1 5/2017 Horchler et al.
2017/0317440 A1 11/2017 Lauermann
2018/0241156 A1 * 8/2018 Huang ..... H01R 13/6471
2018/0316106 A1 11/2018 Rengarajan et al.
2018/0317335 A1 11/2018 Rengarajan et al.

FOREIGN PATENT DOCUMENTS

JP 2009-129708 A 6/2009
KR 10-2009-0029286 A 3/2009
TW 201136063 A 10/2011
WO WO 02/101882 A2 12/2002
WO WO 2006/105484 A1 10/2006
WO WO 2008/156851 A2 12/2008
WO WO 2016/064804 A1 4/2016

OTHER PUBLICATIONS

U.S. Appl. No. 14/995,026, filed Jan. 13, 2016, Buck et al.
U.S. Appl. No. 15/402,146, filed Jan. 9, 2017, Horchler et al.
U.S. Appl. No. 15/520,790, filed Apr. 20, 2017, Lauermann.
U.S. Appl. No. 15/964,246, filed Apr. 27, 2018, Madhumitha.
U.S. Appl. No. 15/964,284, filed Apr. 27, 2018, Madhumitha.
EP 13775244.0, Feb. 28, 2019, European Examination.
PCT/US2015/056346, Jan. 28, 2016, International Search Report and Written Opinion.
PCT/US2015/056346, May 4, 2017, International Preliminary Report on Patentability.
PCT/US2018/029706, Aug. 10, 2018, International Search Report and Written Opinion.
PCT/US2018/029709, Aug. 16, 2018, International Search Report and Written Opinion.
European Examination for European Application No. EP 13775244.0 dated Feb. 28, 2019.
International Search Report and Written Opinion for International Application No. PCT/US2015/056346 dated Jan. 28, 2016.
International Preliminary Report on Patentability for International Application No. PCT/US2015/056346 dated May 4, 2017.
International Search Report and Written Opinion for International Application No. PCT/US2018/029706 dated Aug. 10, 2018.
International Search Report and Written Opinion for International Application No. PCT/US2018/029709 dated Aug. 16, 2018.
[No Author Listed], Gig-Array Connector System. Board/Wire-To-Board Connectors. FCI. Estimated date of publication before 2016. 5 pages.

(56) References Cited

OTHER PUBLICATIONS

[No Author Listed], NeXLev. High-Density Parallel Board Connector. Amphenol TCS. 2009. 2 pages.

* cited by examiner

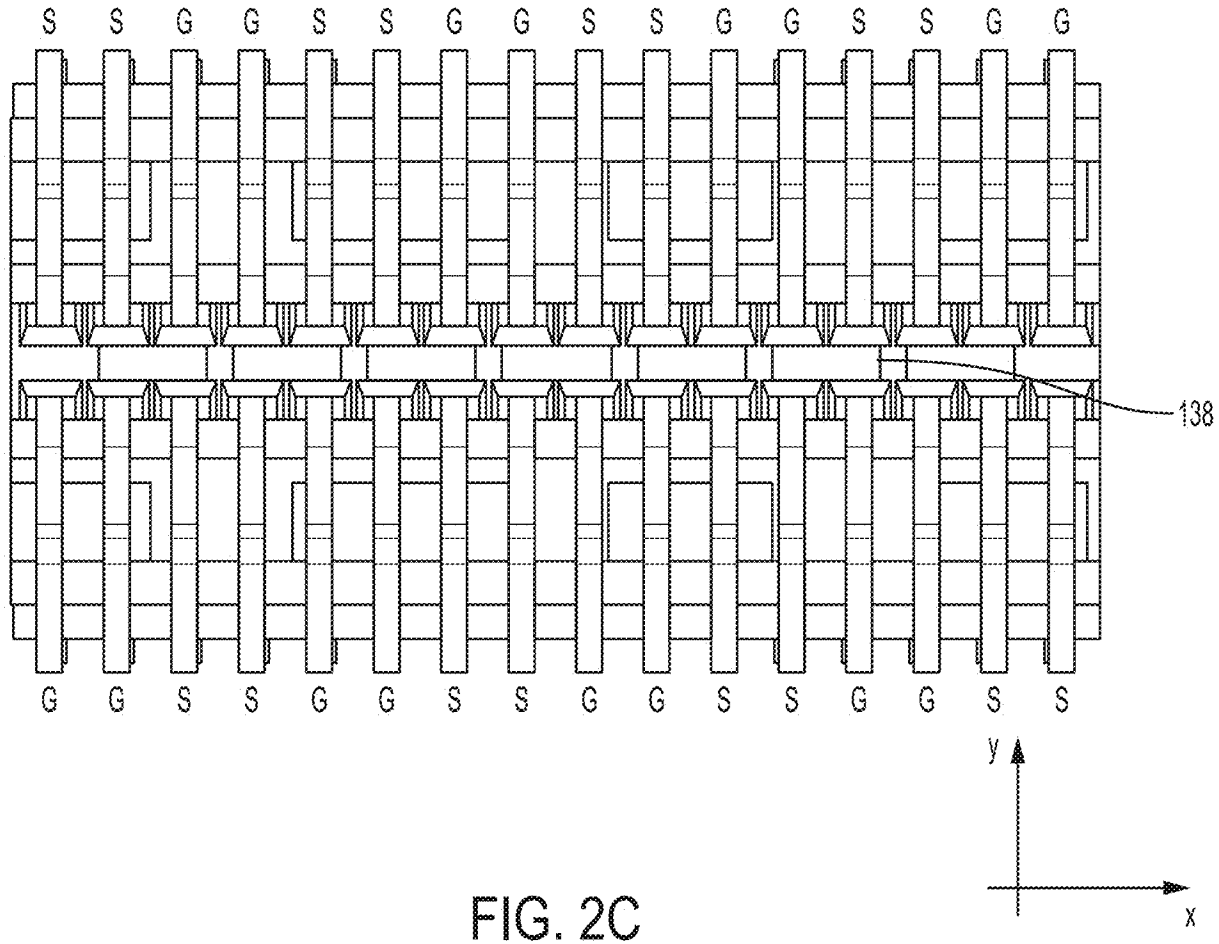
138
G
G
S
S
G
G
S
S
G
G
S
S

STACKING ELECTRICAL CONNECTOR WITH REDUCED CROSSTALK

CROSS REFERENCE TO RELATED APPLICATION

This application claims priority under 35 U.S.C. § 119(e) to U.S. Provisional Patent Application Ser. No. 62/460,644, entitled "STACKING ELECTRICAL CONNECTOR WITH REDUCED CROSSTALK," filed on Feb. 17, 2017, which is hereby incorporated herein by reference in its entirety.

BACKGROUND

This patent application relates generally to interconnection systems, such as those including electrical connectors, used to interconnect electronic assemblies.

Electrical connectors are used in many electronic systems. It is generally easier and more cost effective to manufacture a system as separate electronic assemblies, such as printed circuit boards ("PCBs"), which may be joined together with electrical connectors. A known arrangement for joining two printed circuit boards is to connect them in a stacking configuration. In this configuration, the two printed circuit boards are parallel to one another, and are connected using vertical connector. These connectors are often referred to as "mezzanine connectors" or "stacking connectors". One printed circuit board may have a first mezzanine connector mounted thereon and a second printed circuit board may have a second mezzanine connector mounted thereon. Each one of the mezzanine connectors includes a plurality of contact portions made of a conductive material. When the printed circuit boards are to be connected, the mezzanine connectors are mated, such that corresponding contact portions form electrical contacts.

Regardless of the exact application, electrical connector designs have been adapted to mirror trends in the electronics industry. Electronic systems generally have gotten smaller, faster, and functionally more complex. Because of these changes, the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

BRIEF SUMMARY

According to one aspect of the present application, an electrical connector is provided. The electrical connector may comprise an insulating housing; a first plurality of contact portions, each of the first plurality of contact portions having a mating end, a contact tail, and a body disposed between the mating end and the contact tail, the body being disposed within the insulating housing; a second plurality of contact portions, each of the second plurality of contact portions having a mating end, a contact tail, and a body disposed between the mating end and the contact tail, the body being disposed within the insulating housing; and an opening formed in the insulating housing between the first plurality of contact portions and the second plurality of contact portions.

According to another aspect of the present application, another electrical connector is provided. The electrical connector may comprise an insulating housing; a first row of contact portions, each of the first row of contact portions having a mating end, a contact tail, and a body disposed between the mating end and the contact tail, the body being disposed within the insulating housing; a second row of contact portions, each of the second row of contact portions having a mating end, a contact tail, and a body disposed between the mating end and the contact tail, the body being disposed within the insulating housing; and a plurality of openings formed in the insulating housing and separated from one another by a plurality of beams along a first direction, each of the plurality of openings separating corresponding contacts portions of the first and second rows of contact portions along a second direction.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 2B-2C are plan views of a connector having a plurality of openings formed in the housing, showing a board mounting surface that will face a printed circuit board when the connector is mounted to the printed circuit board, in accordance with some embodiments;

DETAILED DESCRIPTION

Figure 1:
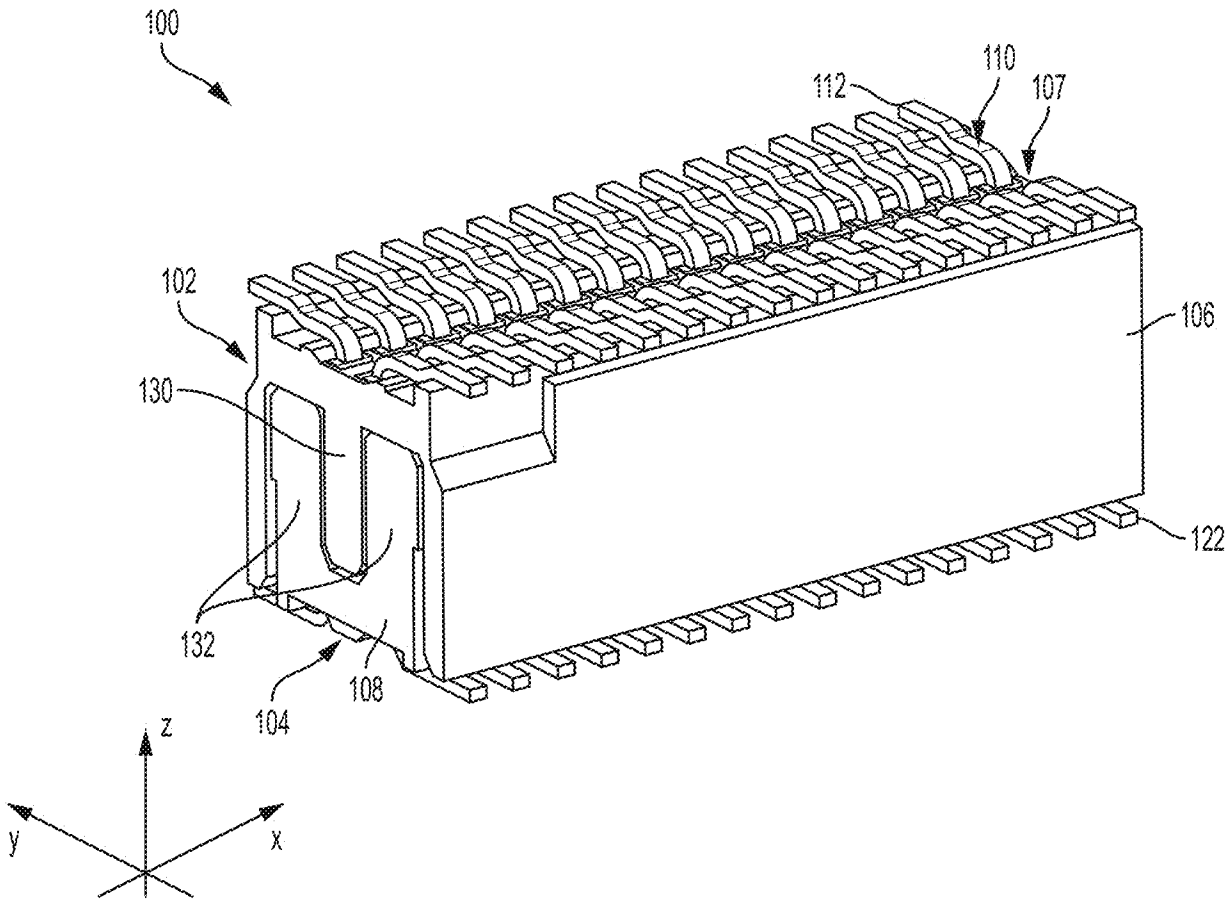
FIG. 1 is an isometric view of a first connector and a second connector shown in a mated configurations, in accordance with some embodiments.

The inventors have recognized and appreciated that incorporating into a connector housing one or more slots between rows of conductors may increase the performance of a high density interconnection system by reducing the effects of signal crosstalk. Such a feature may be used in a mezzanine connector with two rows of conductors.

In some embodiments, crossbeams may be incorporated in the slot between the rows to provide mechanical integrity. Those crossbeams may be positioned to provide low crosstalk. In some embodiments, the crossbeams may be positioned between contacts designated to be of the same type, such as between contacts designated as signal contacts or contacts designated as ground contacts. Such crossbeams may be orthogonal to a direction of the rows of conductors. Alternatively or additionally, the cross beams may be at an angle other than 90 degrees relative to the rows. In some embodiments, the angle of the cross beams may align ends of the crossbeams with contacts in opposing rows that are offset from one another in the row direction.

Signal crosstalk arises in electrical interconnection systems due to electromagnetic coupling between adjacent conductors. Signal crosstalk is undesirable because it may degrade the signal-to-noise ratio (SNR) of the transmitted signals.

The effects of signal crosstalk are particularly severe in high-density connectors, in which the separation between adjacent conductors is small (e.g., less than 1 mm). In fact, the close proximity of adjacent conductors may promote mutual coupling. Furthermore, crosstalk may be exacerbated when the frequency of the signals carried by the connectors is large (e.g., greater than 25 GHz). In recent years, signal frequencies have been significantly increased in response to continuously increasing requirements in data rates. However, at high frequencies, the mutual coupling between adjacent conductors increases, thereby promoting signal crosstalk.

Typical electrical connectors include a plurality of electrically conductive contact portions for carrying electrical signals between mated electrical connectors. In stacking connectors, the contact portions are held together by an insulative housing and are often arranged in parallel rows. The insulative housing is made of a dielectric material, such as plastic.

The inventors have recognized and appreciated that signal crosstalk arising between adjacent contact portions of an electrical connector may be reduced by forming one or more openings through the housing between adjacent rows. In embodiments in which a connection is formed by mating two connectors, openings may be formed in each of the connectors such that the openings align when the connectors are mated.

Without being bound by any theory of operation, the inventors theorize that configurations as described herein improve electrical performance because the relative dielectric constant of the air occupying the opening(s) is lower than the relative dielectric constant of the housing itself, such that the overall effective dielectric constant is reduced between the conductors separated by the opening. This reduction in the effective dielectric constant leads to an increase in the effective electrical distance in the region in which the openings are formed. As a result, in embodiments in which the conductors separated by the air are used to carry signals that are intended to be separate, signal crosstalk is reduced. In some embodiments, one or more openings may be positioned in the housing between adjacent rows of contact portions. In this way, the signal crosstalk between contact portions of different rows is reduced. This result may be particularly applicable to connectors configured for communicating differential signals in edge coupled pairs of signal conductors within the rows.

The opening(s) may extend all the way through the housing (e.g., from a first outer surface to a second outer surface of the housing), thus enhancing the air fill factor. Openings of the type described herein may be used to reduce signal crosstalk in any type of electrical connector. For example, in some embodiments, a mezzanine connector (e.g., a PCI or a PCIe connector) may comprise a housing having one or more openings formed there through. Various examples of mezzanine connectors are described further below. However, the use of openings to reduce signal crosstalk is not limited to mezzanine connectors. Accordingly, in some embodiments, other types of connectors may use openings formed in the connector's housing to reduce signal crosstalk.

For example, openings of the type described herein may be used in connection with board-to-board connectors other than mezzanine connectors, such as right-angled connectors. The openings may be positioned in the connector's housing between adjacent contact portions. In another example, the openings may be used to reduce crosstalk in connectors configured to mate with optical modules, such as SFP, QSFP, micro QSFP, CXP, CFP, or any other suitable type of connector.

FIG. 1 is an isometric view of a portion of an interconnection system, with two connectors shown in a mated configuration, in accordance with some embodiments. Interconnection system 100 may comprise connectors 102 and 104.The two connectors may each comprise a plurality of conductors with contact portions. In the mated configuration, the contact portions of connector 102 may form electrical contacts with the contact portions of connector 104. Interconnection system 100 may be used, in some circumstances, to connect two parallel printed circuit boards in a stacking configuration, such as a motherboard and a daughtercard. In some embodiments, the printed circuit boards may lie in planes parallel to the xy-plane.

In some embodiments, connector 102 is configured to be attached to a motherboard, while connector 104 is configured to be attached to a daughtercard. The opposite arrangement is also possible. In some embodiments, the printed circuit boards may communicate with each other, via interconnection system 100, using a standardized protocol, such as a PCI protocol. In these embodiments, connectors 102 and 104 may be designed to conform with PCI standards, and conductors may be designated for certain functions according to these standards, such as to carry differential signals, power, ground, or low speed single-ended signals.

Such a designation may be made by configuration of the contacts. Ground contacts, for example, may be wider or have a higher inductance than signal conductors. Alternatively or additionally, ground conductors may be longer. As yet another form of designation, adjacent signal contacts may be closer to each other than to adjacent ground conducts or otherwise be configured to provide greater coupling between signal conductors so as to form a differential pair than to an adjacent conductor designated as a ground. Alternatively or additionally, these designations may be based on a standard such that when a connector is attached to a printed circuit board according to the standard, the designated conductors are attached to conducting structures that couple signals or grounds conductors per the designation. Such connections are possible because the connector has conductors positioned according to the designation of the standard.

The conductors in connectors 102 and 104 may also comprise electrically conducting contact tails designed to attach to a corresponding printed circuit board. Interconnection system 100 may be demated by pulling connectors 102 and 104 away from each other along a direction parallel to the z-axis.

Connectors 102 and 104 may each comprise a housing. For example, connector 102 may comprise housing 106 and connector 104 may comprise housing 108. The housings may be made, wholly or in part, of any suitable insulative material, such as plastic or nylon. Examples of suitable materials include, but are not limited to, liquid crystal polymer (LCP), polyphenyline sulfide (PPS), high temperature nylon or polyphenylenoxide (PPO) or polypropylene (PP). Other suitable materials may be employed, as aspects of the present disclosure are not limited in this regard.

The insulative material may be molded to form the desired shape. The housing may hold the plurality of conductors with contact portions in position to mate with the contact portions of conductors in the mating connector. The housing may be molded around the conductors alternatively, the housing may be molded with passages configured to receive the conductors, which may then be inserted into the passages In the embodiment illustrated, the conductors are arranged in multiple, parallel rows. The non-limiting example of FIG. 1 illustrates connectors each having two rows with sixteen contact portions in each row. It should be appreciated, however, that interconnection systems of the type described herein are not limited to the configuration illustrated, as any suitable number of rows and contacts within each row may be used. In the example illustrated, the rows extend along the x-axis and are spaced apart along the y-axis.

Figure 3A:
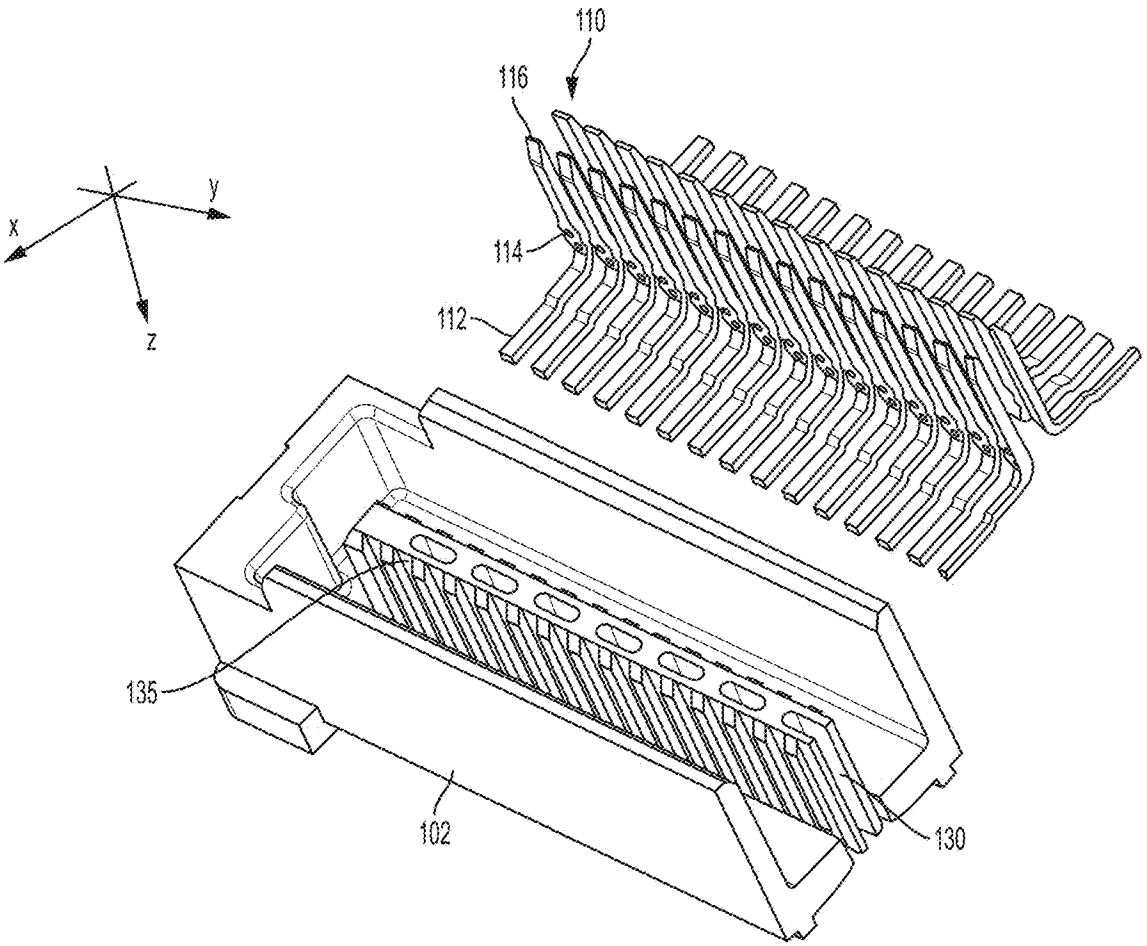
FIG. 3A is an isometric view, partially exploded and partially cut away, of one of the connectors of FIG. 1, in accordance with some embodiments.

As illustrated, housing 106 may hold conductors 110. Conductors 110 may be made of any suitable conductive material, such as copper, or any other suitable metal or alloy of metals. Each conductor 110 may comprise a contact tail 112 and a mating contact portion 116 (as shown in FIG. 3A). The contact tail 112 and the mating contact portion may be joined by an intermediate portion (not numbered).

The contact tails may be used to form electrical contacts with the printed circuit board on which the connector is mounted. For example, the contact tails may form electrical contacts with a corresponding pad disposed on the printed circuit board. The contact tails may be attached to the printed circuit board in any suitable way. For example, the contact tails may be shaped as press fit compliant sections and may be attached to the printed circuit board using a press fit mechanism. However, in the embodiment illustrated, the contact tails are shaped for attachment to a printed circuit board using a surface mount soldering technique.

The mating contact portions 116 of connector 102 (not shown in FIG. 1) may form electrical contacts with corresponding mating ends of connector 104, when the connectors are mated. In this way, electrical signals may be transmitted between the printed circuit boards on which the connectors are mounted. Contact tails 122 may form electrical contacts with the printed circuit board on which connector 104 is mounted.

In some embodiments, the connectors may comprise one or more projecting members for facilitating the mating operations. The projecting members may support the mating portion of the conductors in a way that they are exposed for mating with contact portions of conductors in a mating connector. The projecting members may be part of the connectors' housings. A projecting member may have a free end. The free end may extend in the mating direction (the z-axis in the example shown in FIG. 1), away from the housing. For example, housing 106 may comprise projecting member 130 and housing 108 may comprise projecting members 132. While the illustrated configuration illustrates a housing having one projecting member and the other housing having two projecting members, any other suitable number of projecting members may be used. In the example of FIG. 1, projecting member 130 may fill, at least partially, the cavity formed between projecting members 132 when the connectors are mated with each other.

One or more openings may be formed in the housing of a connector. In some embodiments, the opening(s) may be arranged between adjacent rows of contact portions. As a result, signal crosstalk between contact portions of different rows may be reduced. It should be appreciated that, due to the change in effective dielectric constant caused by the presence of air in the openings, the capacitance associated with the housing may also vary. As a result, the resonant frequency of the connector may shift. According to one aspect of the present application, the opening(s) may be arranged so as to provide a desired shift in the resonant frequency. For example, it may be desirable to move the resonant frequency away from the operating frequency of the interconnection system.

Figure 2A:
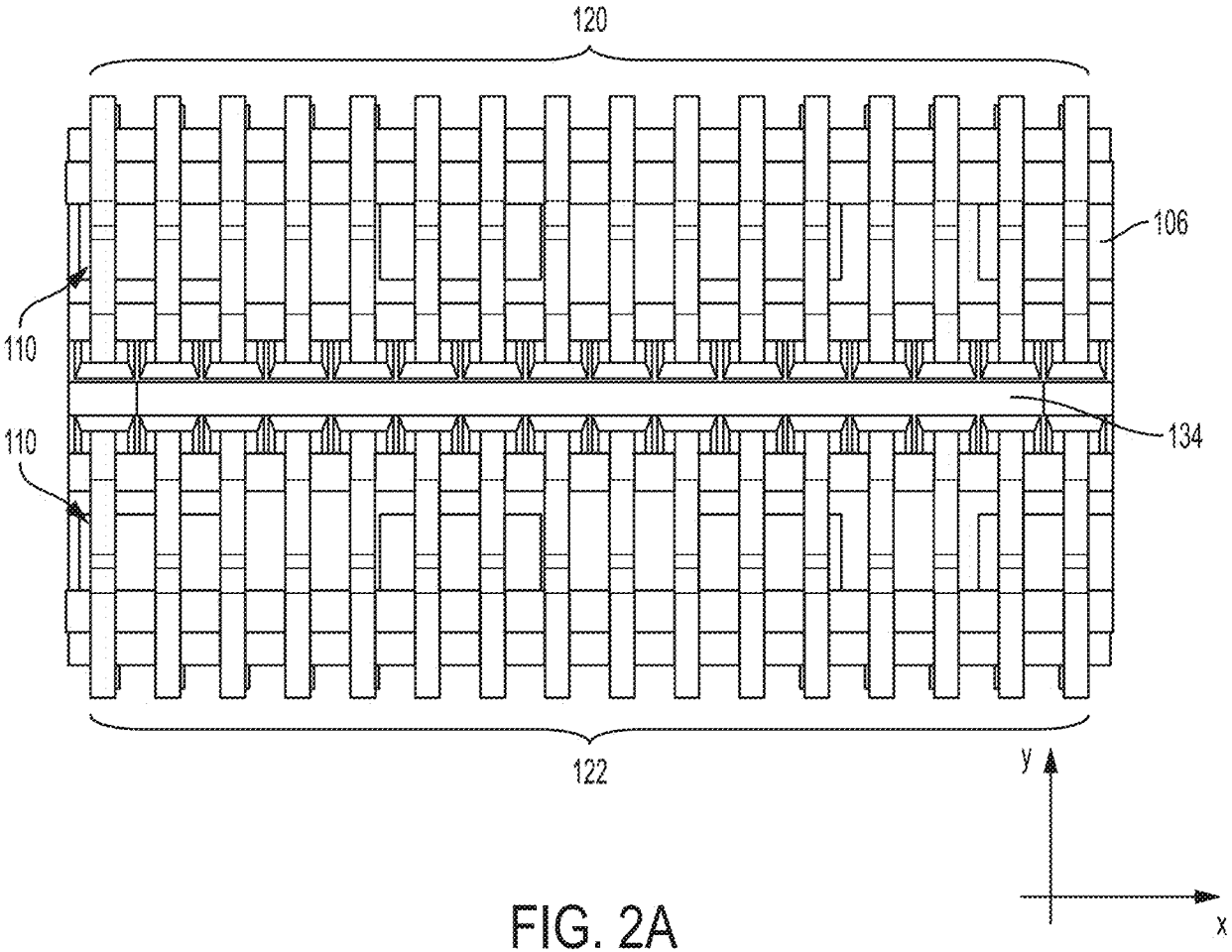
FIG. 2A is a plan view of a connector having an opening formed in the housing, showing a board mounting surface that will face a printed circuit board when the connector is mounted to the printed circuit board, in accordance with some embodiments.

FIG. 2A is a view of a connector, showing contact tails that may be mounted to a printed circuit board. The connector has an opening formed in the housing, in accordance with some embodiments. In this configuration, housing 106 of connector 102 may comprise an opening 134. In some embodiments, opening 134 may be disposed between, in a direction parallel to the y-axis, rows 120 and 122 of conductors 110. In this way, the region of housing 106 between the rows may exhibit a lower effective dielectric constant. In some embodiments, opening 134 may extend, in the mating direction, between a board mounting surface 107 of housing 106 (shown in FIG. 1) and an opposing mating surface. However, the arrangement of opening 134 is not limited in this respect, as opening 134 may extend only through part of the housing.

In the embodiment of FIG. 2A, opening 134 is configured as a continuous slot, extending substantially along the length of each of rows 120 and 122 (the X direction). For example, the slot may extend over at least 80% of the length of each row, and in some embodiments, it may extend at least 85%, 90% or 95%. The slot may occupy a substantial port of the separation, in a direction perpendicular to the rows (the Y direction), between the mating contact portions in the rows 120 and 122. In some embodiments, the slot may occupy greater than 50% of the separation, with embodiments having a slot that occupies at least 60%, at least 70% or at least 80% of the separation. In some embodiments, the separation may be on the order of 5 mm or less, and may, for example, be between 1 mm and 5 mm, or, in some embodiments, between 1.5 mm and 5 mm.

Mating connector 104 alternatively or additionally may include an opening formed in housing 108. The opening in housing 108 may align, when connectors 102 and 104 are mated, with the opening in housing 106 such that a slot may extend from the board mounting face of connector 102 to the board mounting face of connector 104. In the illustrated embodiment, each of connectors 102 and 104 may have the same board mounting interface such that each connector 104, when viewed from the perspective of its board mounting surface, may have an arrangement of conductors and a slot as illustrated in FIG. 2A-2E.

FIGS. 2B-2E illustrate alternative embodiments, in which opening 134 comprises crossbeams, such that a single continuous slot is replaced by a plurality of openings 136. The openings 136 may be separated, along the x-axis, by beams 138. Beams 138 may be part of the housing, and may be arranged to preserve the mechanical strength of the housing. In some embodiments, the openings may have a length, along the x-axis, that is between 0.5 mm and 1.5 mm, between 0.5 mm and 1 mm, between 0.7 mm and 0.9 mm, between 1.2 mm and 1.4 mm, between 0.2 mm and 1 mm, or between any other suitable range within such ranges. Other ranges are also possible. In some embodiments, the openings may have a width, along the y-axis, that is between 0.1 mm and 0.5 mm, between 0.2 mm and 0.4 mm, or between any other suitable range within such ranges. Other ranges are also possible.

Adjacent contact portions 110 may be separated, along the x-axis, by an edge-to-edge distance that is between 0.4 mm and 2 mm, between 0.4 mm and 0.8 mm, between 0.5 mm and 0.7 mm, or between any other suitable range within such ranges. In some embodiments, contact portions 110 may be arranged, along the x-axis, in a periodic configuration, that is, with a constant pitch. The pitch may be between 0.4 mm and 1.6 mm, between 0.7 mm and 0.9 mm, or between any other suitable range within such ranges.

Figure 2B:
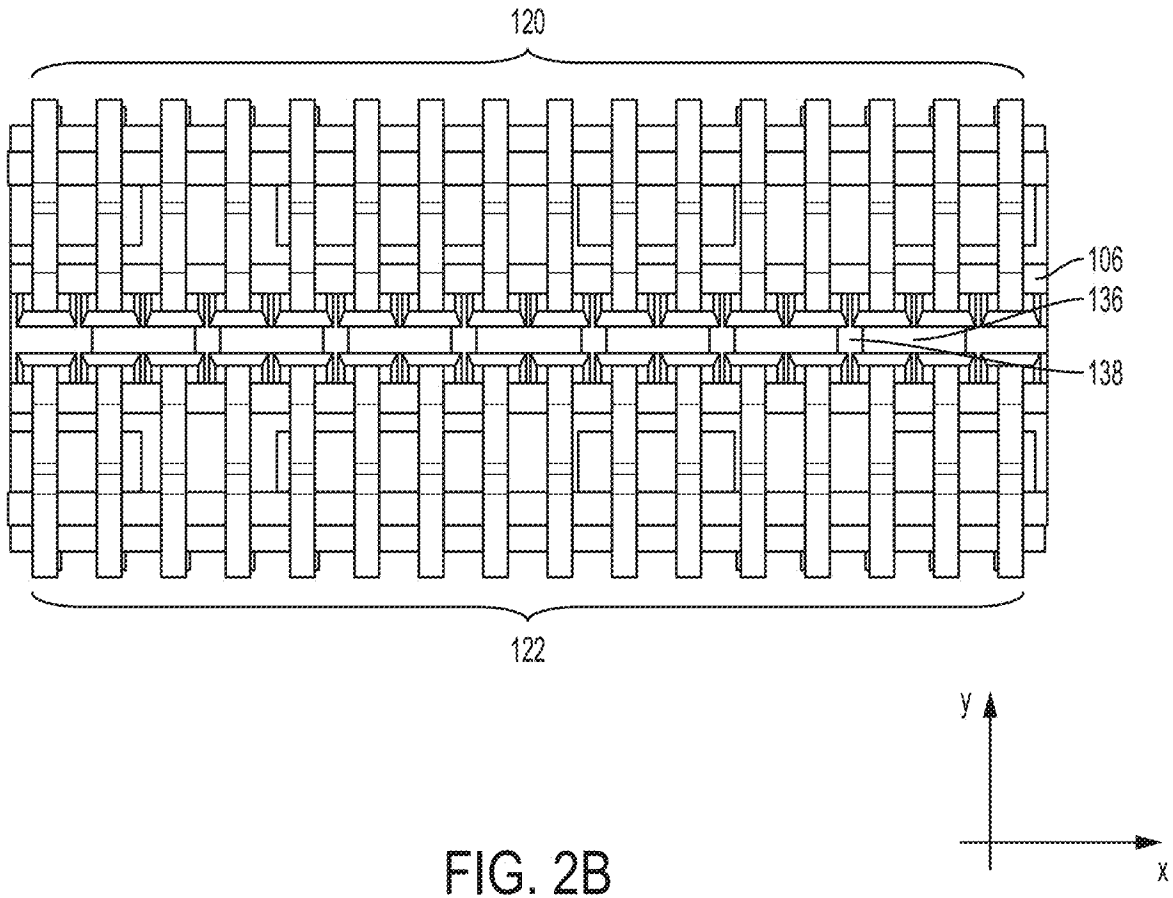

In the embodiment illustrated in FIGS. 2B-2C, openings 136 have a rectangular cross section in the xy-plane, and beams 138 may extend in a direction parallel to the y-axis. In some embodiments, pairs of adjacent conductors may be designated to support differential signals. These conductors will be referred to herein with the letter "S", for signal. Other contact portions may be designated to be connected to a reference potential, such as a ground potential. These conductors will be referred to herein with the letter "G", for ground. Signal contact pairs may be separated from one another by one or more ground contact pairs. For example, in the example of FIG. 2C, signal contact pairs S are separated, in a direction parallel to the x-axis, by a pair of ground contact portions. Other configurations are also possible. In some embodiments, the signal contacts of rows 120 and 122 may be staggered, such that a contact portion of a row is aligned in a direction perpendicular to the rows, with a contact portion of a different type. For example, the aligned contact portions may include one contact portion being S, the other contact portion being G. In this configuration, a signal contact of row 120 may be adjacent, in a direction parallel to the y-axis, a ground contact of row 122.

Regardless of whether the rows are staggered with respect to one another, the designations shown in FIG. 2C results in conductors forming differential pairs being adjacent within the same row. In such a configuration, decreasing coupling between rows, such as may occur from inclusion of a slot in the housing, reduces crosstalk.

In some embodiments, a beam 138 may be positioned, along the x-axis, in proximity to two adjacent contact portions of the same type (e.g., two signal contacts or two ground contacts). This configuration is illustrated in FIG. 2C. In this way, signal cross talk between signal contacts of different rows may be lower than if the crossbeams were to align with the signal conductors in one or both of the rows.

Figure 2D:
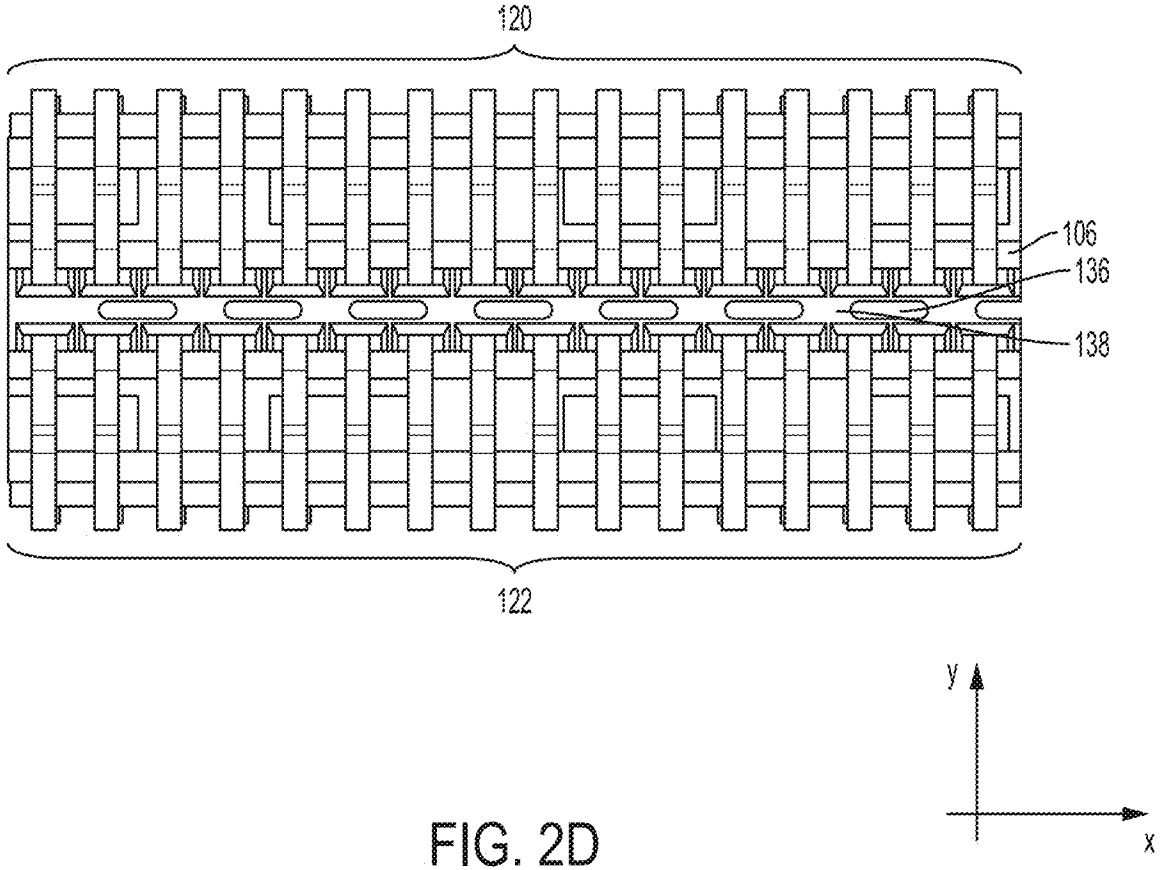
FIG. 2D is a plan view of another connector having a plurality of openings formed in the housing, showing a board mounting surface that will face a printed circuit board when the connector is mounted to the printed circuit board, in accordance with some embodiments.

FIG. 2D illustrates an alternative embodiment. In this embodiment, openings 136 may have rounded edges.

Figure 2E:
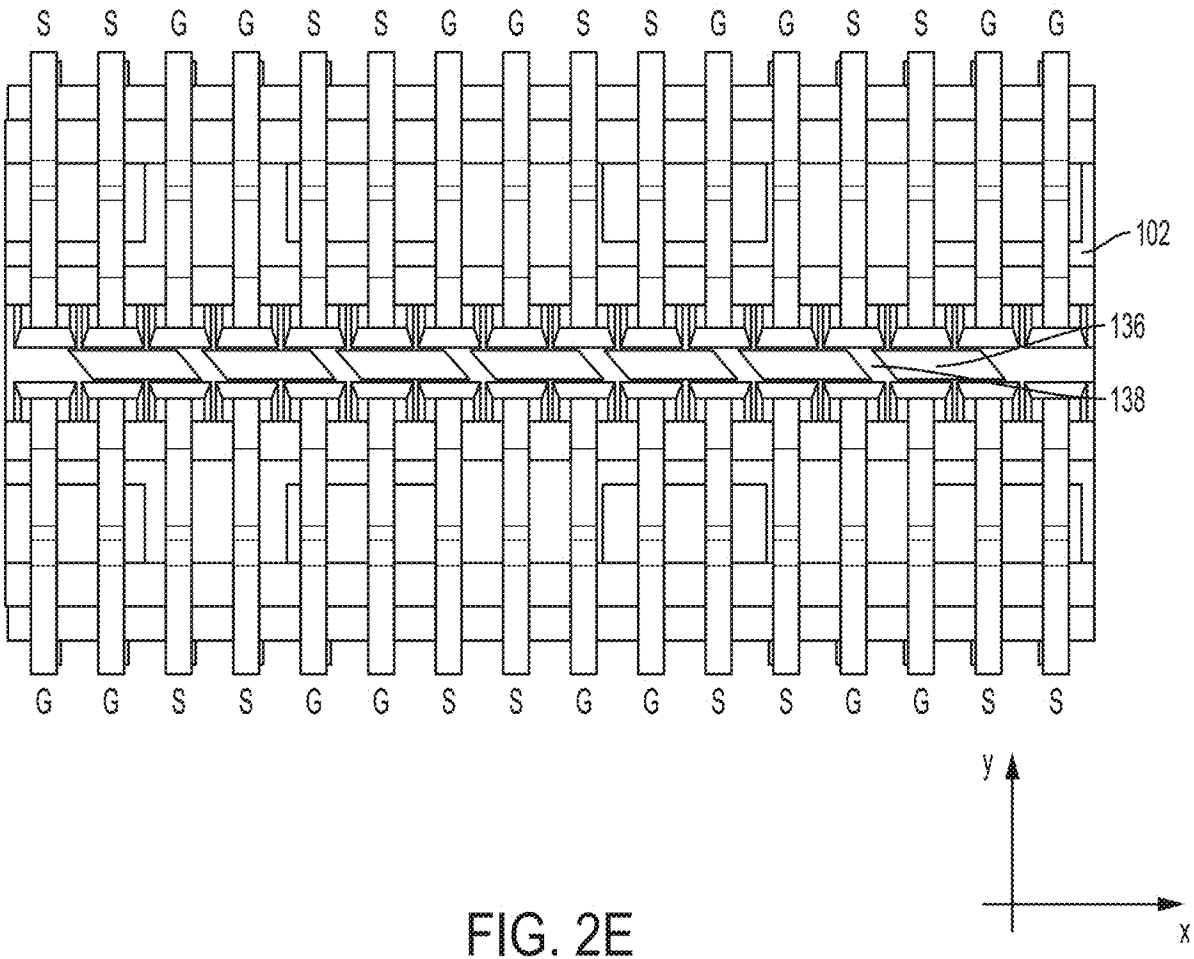
FIG. 2E is a plan view of yet another connector having a plurality of openings formed in the housing, showing a board mounting surface that will face a printed circuit board when the connector is mounted to the printed circuit board, in accordance with some embodiments.

FIG. 2E illustrates yet another embodiment. In this embodiment, beams 138 may be angled with respect to the y-axis. As in the embodiment of FIG. 2D, the beams may be positioned in proximity to two adjacent contact portions of the same type. Each end of the crossbeam, however, is positioned adjacent a different type contact. Crossbeams having a first end between two G conductors in one row may have a second end between two S conductors in the other row. Satisfying this constraint results in the crossbeams being angled with respect to the rows. The beams may form any suitable angle with respect to the y-axis, such as between 0° and 45°.

FIG. 3A is an exploded view of connector 102 viewed from the mating interface side. Housing 106 and conductors 110 are shown. Housing 102 is partially cutaway, at the lower right portion to reveal the mating portions of the connector.

Each conductor110 may comprise a mating end 116, a contact tail 112, and an intermediate portion 114. The intermediate portion may connect the mating end to the contact tail. In some embodiments, intermediate portion 114 comprises a portion having an angle that is substantially 90° (e.g., between 85° and 95°, between 80° and 100°, or between 75° and 105°). In some such embodiments, conductors 110 are arranged in an L-shape. Mating ends 116 may have tapered ends for facilitating mating with corresponding contact portions.

In some embodiments, each of the rows of conductors may be stamped from a sheet of conductor. With this process, each conductor may have two broader sides, joined by edges. Adjacent conductors are aligned edge-to-edge such that, when two adjacent conductors within a row are designated as signal conductors for a differential pair, that pair will have edge-to-edge coupling. Conductors 110 may be held in rows by housing 106. In some embodiments, the contact portions are held by projecting member 130. A plurality of channels 135 may be formed on either sidewall of projecting member 130, and may be arranged for positioning the contact portions with respect to the housing.

Figure 3B:
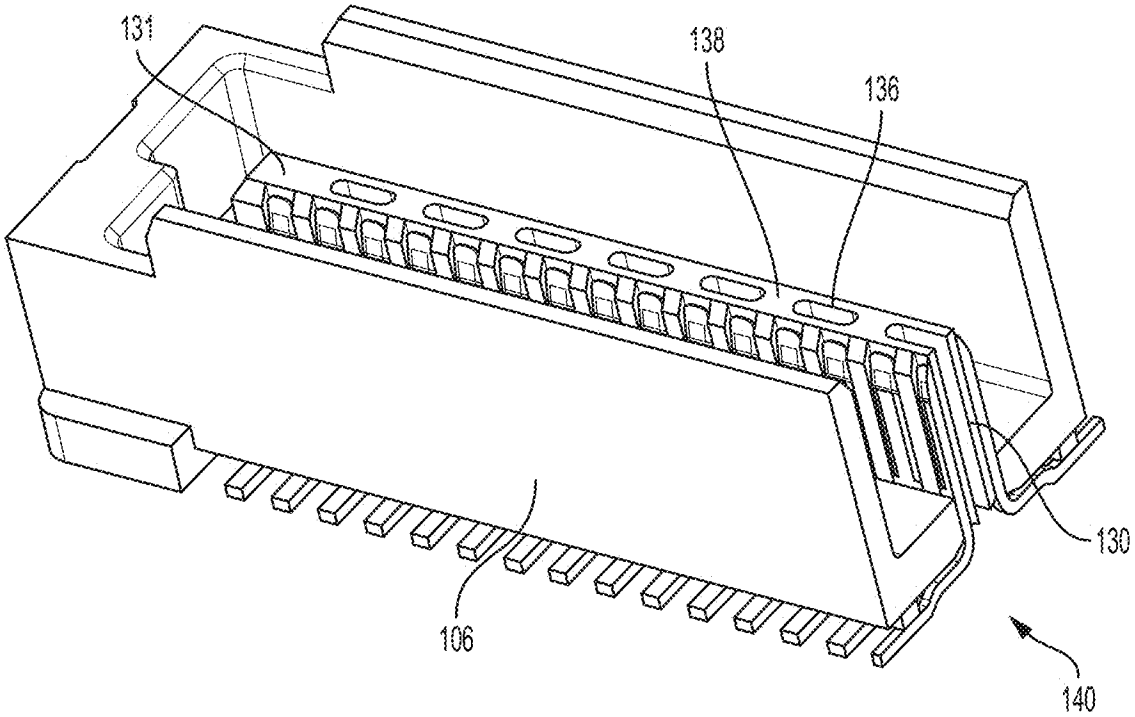
FIG. 3B is an isometric view, partially cut away, of one of the connectors of FIG. 1, in accordance with some embodiments.

FIG. 3B illustrates the connector 102, as in FIG. 3A, when the contact portions are inserted in the housing. As illustrated, each contact portion is positioned in a corresponding channel formed in the projecting member. FIG. 3B further illustrates a plurality of openings 136. The openings may be formed through the projecting member. In some embodiments, the openings may extend between top surface 107 (shown in FIG. 1) and bottom surface 131, thereby forming a channel through the housing.

As should be appreciated from FIGS. 3A and 3B, the conductors of a stacking connector have portions, including the mating contact portions, that are aligned in planes, which are parallel to the Y-Z plane with the axes labeled as illustrated. Those planes have a small separation, which is in the X direction with the axes labeled as illustrated. The slot in the housing, which may appear as a collection of openings 136, occupies this small separation over substantially the entire volume of that separation.

Figure 4:
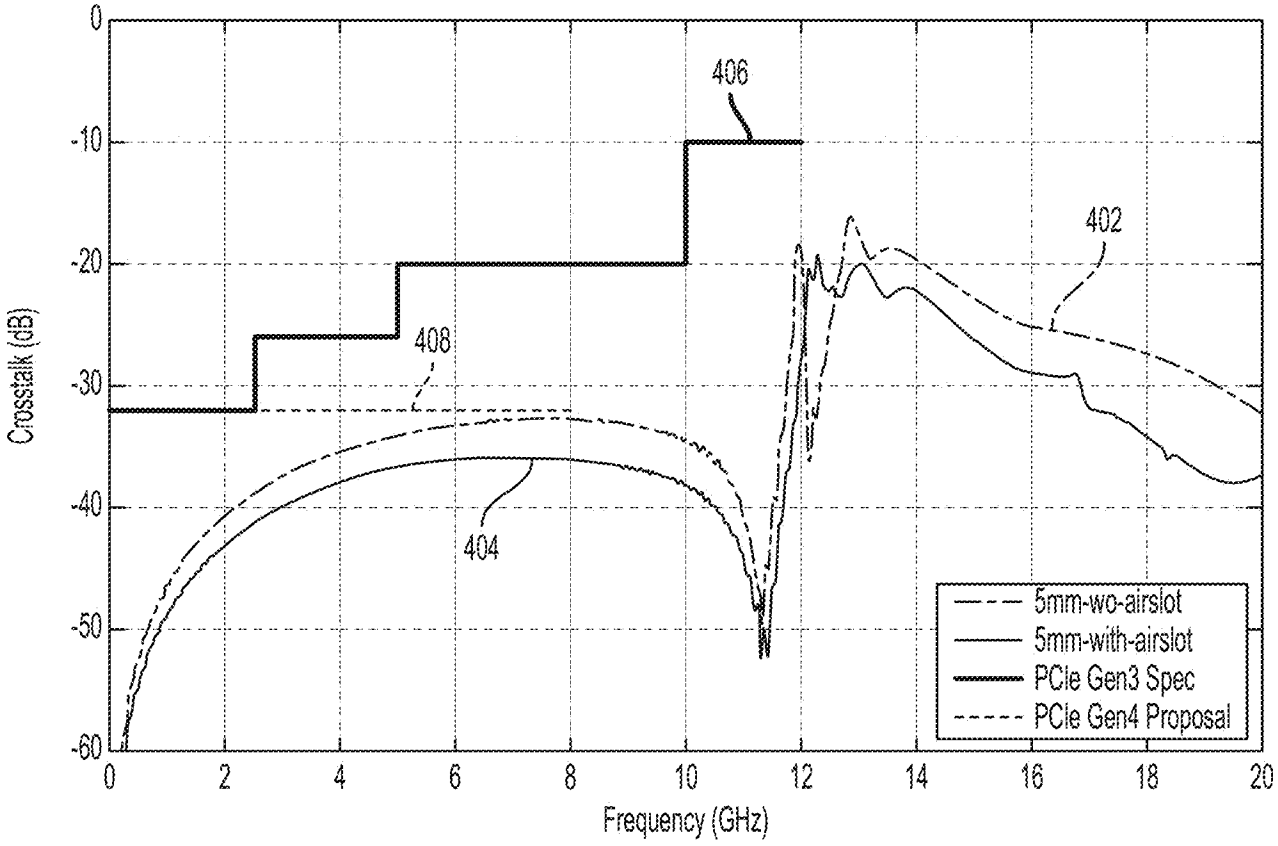
FIG. 4 is a plot illustrating crosstalk as a function of signal frequency for various connector configurations.

FIG. 4 is a plot illustrating signal crosstalk as a function of signal frequency for various connector configurations. For example, curves 402 and 404 illustrate crosstalk at various frequencies for a 5 mm separation between rows. Curve 402 represents a connector not having openings of the type described herein, while curve 404 represents a connector with openings. It should be appreciated that the use of the openings significantly reduces signal crosstalk across most of the frequency range examined. As can be seen, openings as described herein reduce crosstalk on the order of 1-3 dB over a frequency range that span from at least 2 GHz to 10 GHz.

As another example, curve 406 illustrates the crosstalk specifications for a third generation PCIe connector. Curve 408 illustrates crosstalk at various frequencies for a PCIe connector including openings of the type described herein. As illustrated, the crosstalk meets the PCIe specification across the frequency range examined, and surprisingly exceeds a PCIe Gen 4 specification, whereas conventional designs whereas conventional designs marginally meet the specification.

Having thus described several aspects of at least one embodiment of this invention, it is to be appreciated that various alterations, modifications, and improvements will readily occur to those skilled in the art.

For example, it is described that a slot is formed in a connector housing between rows of mating contact portions of conductors. Alternatively or additionally, the slot may be formed or other portions of the conductors.

As an example of another variation, it is described that the slot is full of air. Air has a low dielectric constant relative to an insulative housing. The relative dielectric constant of air, for example, may be about 1.0, which contrasts to a dielectric housing with a relative dielectric constant in the range of about 2.4 to 4.0. The improved performance described herein may be achieved with a slot filled with material other than air, if the relative dielectric constant of that material is low, such as between 1.0 and 2.0 or between 1.0 and 1.5, in some embodiments.

Such alterations, modifications, and improvements are intended to be part of this disclosure, and are intended to be within the spirit and scope of the invention. Further, though advantages of the present invention are indicated, it should be appreciated that not every embodiment of the invention will include every described advantage. Some embodiments may not implement any features described as advantageous herein and in some instances. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed:

1. An electrical connector, comprising:

an insulating housing comprising a projecting member and first and second pluralities of channels formed on opposite sidewalls of the projecting member;

a first plurality of conductors comprising contact portions, each of the first plurality of contact portions having a mating end, a contact tail, and a body disposed between the mating end and the contact tail, the body being retained in a respective channel of the first plurality of channels;

a second plurality of conductors comprising contact portions, each of the second plurality of contact portions having a mating end, a contact tail, and a body disposed between the mating end and the contact tail, the body being retained in a respective channel of the second plurality of channels; and at least one opening formed in the projecting member between the first plurality of channels and the second plurality of channels.

2. The electrical connector of claim 1, wherein the at least one opening forms a third channel between a first outer surface of the insulating housing and a second outer surface of the insulating housing.

3. The electrical connector of claim 2, wherein the first and the second outer surfaces of the insulating housing are parallel to each other.

4. The electrical connector of claim 2, wherein:

the first plurality of conductors comprise portions, including the contact portions, extending in a first plane; and the second plurality of conductors comprise portions, including the contact portions, extending in a second plane, the second plane being parallel to the first plane;

the at least one opening is disposed between the first plane and the second plane.

5. The electrical connector of claim 1, wherein the at least one opening comprises a slot and a plurality of beams spanning the slot.

6. The electric connector of claim 5, wherein a first contact portion of the first plurality of contact portions and a corresponding second contact portion of the second plurality of contact portions are separated along a first direction, and wherein the plurality of beams are parallel to the first direction.

7. The electric connector of claim 5, wherein a first contact portion of the first plurality of contact portions and a corresponding second contact portion of the second plurality of contact portions are separated along a first direction, and wherein the beam is angled with respect to the first direction.

8. The electric connector of claim 5, wherein the slot has a length that is between 0.2 mm and 1 mm.

9. The electric connector of claim 5, wherein the slot has a width that is between 0.1 mm and 0.5 mm.

10. The electric connector of claim 1, wherein adjacent contact portions of the first plurality of contact portions are separated by a distance that is between 0.4 mm and 0.8 mm.

11. An electric connector comprising:

an insulating housing;

a first plurality of conductors, each of the conductors having a mating end, a contact tail, and an intermediate portion disposed between the mating end and the contact tail, the intermediate portion being held by the insulating housing and the contact portions being positioned in a first row;

a second plurality of conductors, each of the conductors having a mating end, a contact tail, and an intermediate portion disposed between the mating end and the contact tail, the intermediate portion being held by the insulating housing and the contact portions being positioned in a second row; and a slot enclosed within dielectric material of the insulating housing between the first row and the second row.

12. The electric connector of claim 11, wherein:

the housing comprises a plurality of beams spanning the slot.

13. The electric connector of claim 12, wherein the plurality of beams are angled between 30 and 60 degrees with respect to an elongated dimension of the slot.

14. The electric connector of claim 13, wherein the connector is a stacked connector.

15. The electric connector of claim 11, wherein the first row of contact portions is arranged in a SSGG configuration.

16. The electric connector of claim 15, wherein the second row of contact portions is arranged in a GGSS configuration, such that ground contact portions of the first row of contact portions oppose a corresponding signal contact portion of the second row of contact portions along the second direction and signal contact portions of the first row of contact portions oppose a corresponding ground contact portion of the second row of contact portions along the second direction.

17. The electric connector of claim 16, wherein pairs of adjacent signal contact portions are configured to carry an edge coupled differential signal.

18. The electric connector of claim 16, wherein the housing further comprises a plurality of beams spanning the slot; and a first end of each of the plurality of beams is disposed between adjacent contacts portions of a signal conductor in the first row.

19. The electric connector of claim 18, wherein:

an second end of each of the plurality of beams is disposed between adjacent contacts portions of a ground conductor in the second row.

20. An electrical connector, comprising:

an insulating housing;

a first plurality of conductors comprising contact portions, each of the first plurality of contact portions having a mating end, a contact tail, and a body disposed between the mating end and the contact tail, the body being held by the insulating housing;

a second plurality of conductors comprising contact portions, each of the second plurality of contact portions having a mating end, a contact tail, and a body disposed between the mating end and the contact tail, the body being held by the insulating housing; and at least one opening formed in the insulating housing between the first plurality of contact portions and the second plurality of contact portions, wherein there are no contact portions in the at least one opening.

21. The electric connector of claim 20, wherein:

the at least one opening is enclosed within dielectric material.

22. The electrical connector of claim 20, wherein the at least one opening forms a channel between a first outer surface of the insulating housing and a second outer surface of the insulating housing.

23. The electrical connector of claim 20, wherein the at least one opening comprises a slot and a plurality of beams spanning the slot.

24. The electric connector of claim 23, wherein the slot has a length that is between 0.2 mm and 1 mm.

25. The electric connector of claim 1, wherein:

mating ends of the first plurality of conductors are positioned in respective channels of the first plurality of channels.

* * * * *